United States Patent [19]

Roca-Nierga et al.

[11] Patent Number: 4,463,726

[45] Date of Patent: Aug. 7, 1984

[54] DISTRIBUTOR PUMP FOR INJECTING FUEL INTO INTERNAL COMBUSTION ENGINES

[75] Inventors: Manuel Roca-Nierga, Barcelona, Spain; Mauro Forapianti, Leghorn, Italy

[73] Assignee: Spica S.p.A., Leghorn, Italy

[21] Appl. No.: 328,803

[22] Filed: Dec. 9, 1981

[30] Foreign Application Priority Data

Dec. 29, 1980 [DE] Fed. Rep. of Germany ..... 3049366

[51] Int. Cl.[3] ..... F02M 37/04

[52] U.S. Cl. ..... 123/449; 123/503; 417/462

[58] Field of Search ..... 123/449, 500, 450, 501, 123/503, 506; 417/462, 253, 252

[56] References Cited

U.S. PATENT DOCUMENTS

| | | | |
|---|---|---|---|
| 3,908,619 | 9/1975 | Bittelmeyer | 123/449 |
| 4,271,808 | 6/1981 | Kobayashi | 123/449 |
| 4,327,696 | 5/1982 | Kobayashi | 123/449 |
| 4,392,469 | 7/1983 | Wessel | 123/449 |

*Primary Examiner*—Charles J. Myhre
*Assistant Examiner*—Carl Stuart Miller
*Attorney, Agent, or Firm*—Diller, Ramik & Wight

[57] ABSTRACT

The invention relates to a distributor-type injection pump for feeding fuel to an internal combustion engine, and provided with means capable of ensuring that the fuel pressures in the various delivery ducts connected to the various engine cylinders are equal.

4 Claims, 3 Drawing Figures

10
5
3
7
8
2
5
6
28
17
14
12
11
II
31
21
II
27
1
9
22
16
9
29
13
15
19
4
24
18
30
26
20
25

DISTRIBUTOR PUMP FOR INJECTING FUEL INTO INTERNAL COMBUSTION ENGINES

This invention relates to a distributor-type injection pump for feeding fuel to an internal combustion engine. Said injection pump comprises a piston driven with reciprocating and rotary motion and cooperating with a cylinder to form therewith a passage chamber in order to determine, in phase with the opening of suitable ports, the fuel intake and distribution to the injectors associated with the various engine cylinders.

The injected fuel quantity is regulated in known manner by a cylindrical ring which slides on a portion of the outer surface of the piston to open one or more discharge bores towards a low pressure chamber.

An assembly of ducts and grooves is provided on the cylindrical surface of the piston in order to balance, at any moment of the pump working cycle, the pressure of the fluid contained in the initial portion of the delivery ducts with the feed pressure of the hydraulic head at the commencement of pumping.

The object of the present invention is to ensure that the fuel pressures in the various delivery ducts connected to the various engine cylinders are equal at the commencement of delivery. This is to ensure maximum uniformity in the quantity of liquid injected into the various cylinders. This uniformity is of basic importance for balanced engine operation, particularly under idling conditions.

In one known method, this object is attained by successively connecting the various delivery ducts to the feed chamber by means of channels which also form part of the fuel injection circuit.

This method makes it possible to balance the residual pressure in the delivery ducts at the end of the preceding injection with the feed pressure, but has two drawbacks.

The first is that it increases the dead volumes of liquid subjected to high pressure, thus making it more difficult to control the variation in the injection rate and the quantity of fuel injected, particulary at low throughputs.

The second is represented by the need to make the auxiliary connection between the delivery ducts and feed chamber only during the intake stage of the pumping element.

This considerably limits the time available for balancing the residual pressure with the feed pressure.

The present invention obviates the aforesaid drawbacks of the conventional method by limiting the dead volumes in the pumping chamber in order to ensure good volumetric efficiency even for smaller throughputs, and by sufficiently increasing the times during which the delivery ducts are in communication with that zone of the hydraulic head at feed pressure.

A further object of the invention is to provide a pump which enables the axial position of the piston in which delivery to the injectors commences to be identified with accuracy.

These objects are attained according to the invention by an injection pump provided with a pumping chamber in which a piston slides with reciprocating motion and acts as a distributor by virture of rotary motion, and comprises at least one feed cavity and one delivery cavity which cooperate selectively and respectively with feed and delivery ducts opening into the chamber wall and swept by said piston in order to put them into communication with the pumping chamber, characterised in that on said piston there are also formed two spaced-apart circumferential channels, the first communicating with the piston crown and the second extending into a recess in the piston in a position corresponding with the mouths of the delivery ducts, a further duct which connects said second channel to the injection pump feed duct opening into that wall zone of the chamber swept by the piston portion in which said channels are formed, the connection between said further duct and said first channel being limited to a fraction of the stroke corresponding to the reciprocating motion of the piston.

The structural and operational characteristics of the invention and its advantages compared with the known art will be more apparent from an examination of the description given hereinafter by way of example with reference to the accompanying diagrammatic drawings, in which.

Figure 1:
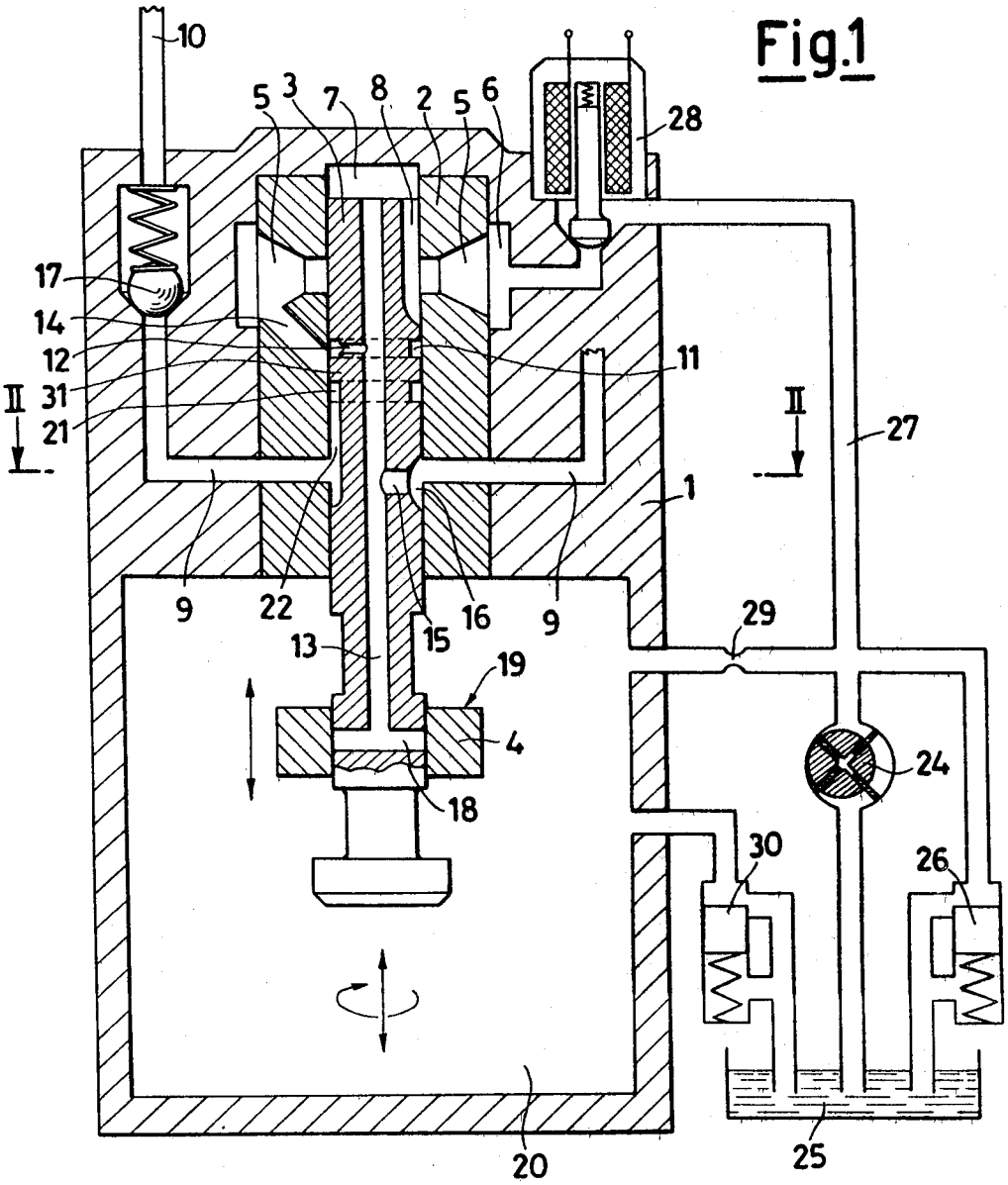
FIG. 1 is a section showing an injection pump constructed according to the principles of the invention.

With reference to FIG. 1, the casing 1, shown in diagrammatic elementary form, of an injection pump contains a hydraulic head comprising the cylinder 2, piston 3 and regulator ring 4. Various feed ducts 5 are provided in the cylinder to connect an annular feed chamber 6, which can be provided in the pump casing (as in the figure) or in the periphery of the cylinder, to the inner cylindrical bore of the pumping element.

One or more feed cavities 8 are provided in the end portion of the cylindrical surface of the piston 3 (shown at its botton dead centre) adjacent to the pressure chamber 7, and connect the feed bores 5 to said pressure chamber 7 during the piston intake stage in order to fill the chamber.

The piston 3 is driven with alternating and rotary motion by known mechanisms, not shown, to determine the intake, pumping and distribution of the fuel in phase with the uncovering, or otherwise, of the feed ducts 5 and delivery ducts 9 which connect the hydraulic head to the injection pipes 10.

The commencement of delivery takes place when, during the compression stroke of the piston 3, the lower edge of a first circular channel 11 connected to the pressure chamber 7 by the transverse bore 12 and longitudinal bore 13 closes the upper portion of the mouth section of the inclined bore or duct 14, thus preventing the fuel from flowing back to the feed duct 5. In this stage, the rotary movement of the piston will already have caused interruption of the connection between the cavity or cavities 8 and the ducts 5.

The fuel compressed in the pressure chamber 7 is distributed to the various delivery ducts 9 by way of the central bore 13 inside the piston 3, the transverse bore 15 and the distribution cavity 16.

The control valve 17 is connected between the delivery ducts 9 and the injection pipes 10 associated with the various engine cylinders.

The end of delivery takes place when, during the compression stroke of the piston 3, the upper edge of the transverse bore 18 connected to the central bore 13 becomes uncovered by the cooperating wall 19 of the regulator ring 4, so enabling the excess fuel to flow back to the discharge chamber 20. The axial position of the ring 4, which is governed by a regulator of known type, thus determines the quantity of fuel injected into the various internal combustion engine cylinders by the respective injector units (not shown in the figure).

The piston 3 is also provided in its cylindrical surface with a second circular channel 21, which is connected continuously to the feed chamber 6 by way of the inclined bore 14 and feed duct 5.

One or more longitudinal slots 22 (see also FIG. 2) branch downwards from the circular channel 21, and become connected to the delivery ducts 9 during part of the period in which each of these latter is not involved with the injection stage. This connection enables the residual pressure of the fuel contained in that portion of the delivery ducts 9 between the piston 3 and valve 17 at the end of each injection operation to be balanced with the feed pressure. This balancing to a single pressure value leads to improved uniformity in the injected fuel quantity between the various cylinders.

Figure 2:
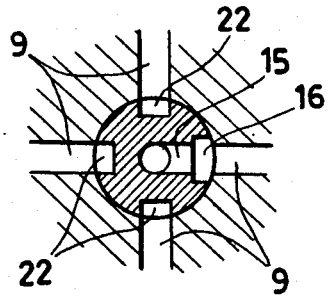
FIG. 2 is a section on the line II—II of FIG. 1.
Figure 3:
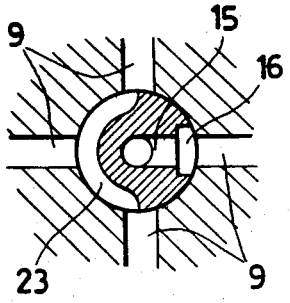
FIG. 3 is a section similar to that of FIG. 2, but showing a modification.

In a second version (FIG. 3), the lower end portion of any one of the balancing slots 22 of FIG. 2 opens into a channel 23 extending through a circumferential arc such as to give simultaneous connection to at least two of the delivery ducts 9 not involved in the injection stage. This latter version leads to longer balancing times than the former.

A feed pump 24 feeds fuel to the injection pump by withdrawing it from the tank 25. The feed pressure is determined by the setting of the return flow valve 26.

A solenoid valve 28 housed in the pump casing is connected between the feed pipe 27 and the chamber 6, in order to interrupt the fuel flow to the hydraulic head when it is required to stop the internal combustion engine.

As said solenoid valve is of the normally closed type, fuel feed to the chamber 6 is allowed only when electrical voltage is present across the valve solenoid. For this reason, the solenoid valve 28 is usually connected to the switch on the vehicle electric panel.

In order to accelerate emptying of the feed chamber 6 and the ducts connected thereto after operating the electrical stop control, and thus minimise any delay in the effective stopping of the engine, the pressure in the discharge chamber 20 is maintained at a value substantially lower than the feed pressure by means of the flow constriction 29 and the discharge valve 30.

Transfer between the feed chamber 6 and discharge chamber 20 is carried out over the entire stroke of the piston 3 during which the surface 19 of the regulator ring 4 leaves the upper edge of the transverse bore 18 uncovered.

The fuel contained in the discharge chamber 20 also serves as a lubricant for the mechanical units (not shown in the figure) housed in said chamber.

The object of the invention is therefore attained by completely separating the pressure balancing circuit from the injection circuit. Besides reducing the dead volumes subjected to the injection pressure, this allows phase independence between the balancing operation and the working cycle of the pumping element. It is also possible to shape the balancing cavity (see the example in FIG. 3) such as to provide a considerable lengthening of the time of connection to the feed channel, and to allow this action to be exerted on several delivery ducts simultaneously.

Moreover, the inclined bore 14 connecting the fuel feed chamber 6 to the inner surface of the bore housing the piston 3 performs two functions:

(1) it connects the feed chamber 6 during the entire piston stroke to the circular channel 21 from which the longitudinal balancing slots 22 branch. This continuous connection enables pressure balancing in the delivery ducts to be carried out at any moment during the time in which each of them is not directly involved in the injection stage; and (2) it connects the pressure chamber 7 to the feed chamber 6 during the first portion of the piston compression stroke, thus enabling the compressed fuel to flow back to the feed ducts. The connection between the two chambers is made by way of the longitudinal bore 13, the transverse bore 12, the circular channel 11 and the inclined bore 14. This connection is interrupted when the upper edge of the collar 31 (lying between the two circular channels 11 and 21) covers the upper portion of the mouth of the inclined bore 14 in the cylinder, during the compression stroke. This event therefore determines the commencement of the fuel delivery to the injectors.

From the description it is apparent that as the commencement of delivery is determined exclusively by the axial movement of the pumping element or piston 3 (and is thus uninfluenced by the rotary movement thereof), it remains constant for all the injection pipes 10, with considerable advantages in terms of phase accuracy and quantity injected for the various cylinders.

We claim:

1. An injection pump comprising means for defining a pumping chamber within a housing, a piston mounted for rotary and reciprocal motion relative to said pumping chamber, feed duct means for feeding fuel into said pumping chamber, said feed duct means including first passage means in said housing and second passage means on said piston for delivering fuel to said pumping chamber upon fluid communication being established therebetween through the selective rotary and reciprocal motion of said piston, delivery duct means for delivering fuel from said pumping chamber, said delivery duct means including third passage means in said piston and fourth passage means in said housing for delivering fuel from said pumping chamber upon fluid communication being established therebetween through the selective rotary and reciprocal motion of said piston, said piston including a pair of axially spaced circumferential channels, fifth passage means for placing said third passage means in fluid communication with a first of said pair of circumferential channels, sixth passage means for placing a second of said pair of circumferential channels in fluid communication with said fourth passage means a circumferential wall portion disposed between said first and second circumferential channels, seventh passage means in said housing for placing said first passage means in selective fluid communication with said first and second circumferential channels through the selective rotary and reciprocal motion of said piston, said first circumferential channel and said seventh passage means being in fluid communication during at least a portion of the compression stroke of said piston, and said circumferential wall portion limiting the fluid communication between said first circumferential channel and said seventh passage means to only a fraction of the reciprocal stroke of said piston.

2. The injection pump as defined in claim 1 including at least another passage means corresponding to said sixth passage means in fluid communication with said second circumferential channel, and eighth passage means for placing said sixth and another passage means in fluid communication with each other through the selective rotary and reciprocal motor of said piston.

3. The injection pump as claimed in claim 2 wherein said another passage means circumscribes a circumferential arc of said piston.

4. The injection pump as claimed in claim 2 wherein said another passage means circumscribes a circumferential arc of said piston, a plurality of said fourth passage means, and said arcuate another passage means being in fluid communication with at least two of said fourth passage means.

* * * * *